US011255139B2

(12) United States Patent
Wright

(10) Patent No.: US 11,255,139 B2
(45) Date of Patent: Feb. 22, 2022

(54) SEALING/LOCKING ROD SAFETY CLAMP AND RAM SYSTEM

(71) Applicant: RISUN OILFLOW SOLUTIONS INC., Nisku (CA)

(72) Inventor: Andrew Wright, Nisku (CA)

(73) Assignee: RISUN OILFLOW SOLUTIONS INC., Nisku (CA)

( * ) Notice: Subject to any disclaimer, the term of this patent is extended or adjusted under 35 U.S.C. 154(b) by 100 days.

(21) Appl. No.: 16/342,168

(22) PCT Filed: Oct. 17, 2017

(86) PCT No.: PCT/CA2017/051236

§ 371 (c)(1),
(2) Date: Apr. 15, 2019

(87) PCT Pub. No.: WO2018/072019

PCT Pub. Date: Apr. 26, 2018

(65) Prior Publication Data

US 2019/0234157 A1 Aug. 1, 2019

Related U.S. Application Data

(60) Provisional application No. 62/409,223, filed on Oct. 17, 2016.

(51) Int. Cl.
*E21B 19/12* (2006.01)
*E21B 43/12* (2006.01)

(52) U.S. Cl.
CPC ..... *E21B 19/12* (2013.01); *E21B 43/126* (2013.01)

(58) Field of Classification Search
CPC ..... E21B 19/12; E21B 43/126
See application file for complete search history.

(56) References Cited

U.S. PATENT DOCUMENTS

| | | | | |
|---|---|---|---|---|
| 4,716,961 A * | 1/1988 | Makins, Jr | E21B 43/126 166/68.5 |
| 5,551,510 A * | 9/1996 | Mills | E21B 43/126 166/68 |
| 7,044,217 B2 | 5/2006 | Hult | |
| 7,199,497 B2 | 4/2007 | Tessier | |
| 7,673,674 B2 * | 3/2010 | Lam | E21B 43/126 166/75.11 |
| 8,016,027 B2 * | 9/2011 | Boyles | E21B 43/126 166/68.5 |

(Continued)

FOREIGN PATENT DOCUMENTS

| | | | |
|---|---|---|---|
| CA | 2171899 | 10/1996 | |
| CN | 106223870 A * | 8/2016 | E21B 17/1071 |

OTHER PUBLICATIONS

International Search Report and Written Opinion prepared by the Canadian Intellectual Property Office dated Dec. 5, 2017, for International Application No. PCT/CA2017/051236.

(Continued)

*Primary Examiner* — Steven A MacDonald
(74) *Attorney, Agent, or Firm* — Foley & Lardner LLP

(57) ABSTRACT

Sealing/locking rod safety clamp systems and components are provided. In some embodiments, the systems can comprise a locking rod clamp, a lockable drive motor shaft, and locking shaft rams. Methods of use of sealing/locking rod safety clamp systems and components are also provided.

17 Claims, 10 Drawing Sheets

(56) References Cited

U.S. PATENT DOCUMENTS

| | | | | |
|---|---|---|---|---|
| 2007/0175625 | A1* | 8/2007 | Lam | E21B 43/126 166/85.1 |
| 2007/0175626 | A1 | 8/2007 | Lam | |
| 2008/0078965 | A1* | 4/2008 | Lane | E21B 19/12 251/1.3 |
| 2008/0296011 | A1* | 12/2008 | Hult | F04C 15/0084 166/75.11 |
| 2009/0032240 | A1* | 2/2009 | Boyles | E21B 43/126 166/68.5 |
| 2012/0247754 | A1* | 10/2012 | Wright | E21B 43/126 166/84.1 |
| 2013/0199773 | A1* | 8/2013 | Tebay | E21B 33/08 166/84.1 |
| 2014/0048246 | A1* | 2/2014 | Cemin | F04C 14/28 166/65.1 |
| 2016/0005375 | A1 | 1/2016 | Naijo et al. | |
| 2016/0053758 | A1* | 2/2016 | Wu | F04C 13/008 417/374 |
| 2017/0009549 | A1* | 1/2017 | Bhatnagar | E21B 33/062 |

OTHER PUBLICATIONS

"Annular Preventers—Well Control Equipment," Drilling Formulas and Drilling Calculations, Jul. 16, 2012, 10 pages [retrieved online from: www.drillingformulas.com/annular-preventers/].

English Translation of Official Action for Columbia Patent Application No. NC2019/0004781, date unknown, 9 pages.

* cited by examiner

SEALING/LOCKING ROD SAFETY CLAMP AND RAM SYSTEM

CROSS REFERENCE TO RELATED APPLICATIONS

This application is a national stage application under 35 U.S.C. 371 and claims the benefit of PCT Application No. PCT/CA2017/051236 having an international filing date of 17 Oct. 2017, which designated the United States, which PCT application claimed the benefit of U.S. Provisional Application No. 62/409,223, filed Oct. 17, 2016, the entire disclosures of each of which are incorporated herein by reference.

TECHNICAL FIELD

The invention relates to polish rod clamps and rod clamp systems for use with oil well drive heads.

BACKGROUND OF THE INVENTION

Clamps used in the oil and gas industry grip and hold the rotation of the polish rod positioned at the top of a drive head. These clamps are used to hold the rod in tension only and sit at the top of the drive head. A polish rod is sealed with a stuffing box (mounted separately) that rotates with the rod or static seals. The stuffing box can be mounted above or below the drive head, depending on the type of drive head systems operation on the drive motor. The rod clamp does not prevent the rods from coming out of hole if pressure or sand is exerted at the rotor. This can cause the entire working rod string to lift up the clamp with polish rod and become a whip, posing a danger at the surface. Also if the seal contact is lost with the polish rod, the stuffing box would lose pressure sealing. This action of the polish rod coming out of the hole can damage equipment and operators unknowingly. The industry standard is to lock the polish rod from moving when there is no rotation, so the rod does not move, with a locking seal rod blowout preventer (BOP).

Drive motors presently have a small shaft inner diameter (also referred to herein as "ID") which does not allow for rod and rotor service work. The drive head needs to be removed to allow access to the tubing string. This is a costly operation, which could damage the equipment and pose safety concerns. Further, the reduction of moving parts like the stuffing box at the surface would lead to fewer repairs and ease of replacing rod sealing.

SUMMARY OF THE INVENTION

Sealing/locking rod safety clamp systems and components are provided. In some embodiments, the systems can comprise a locking rod clamp, a lockable drive motor shaft, and locking shaft rams. Methods of use of sealing/locking rod safety clamp systems and components are also provided.

Broadly stated, in some embodiments, a polish rod or rod clamp and locking ram system is provided, the system comprising: a locking polish rod safety clamp for clamping a seal onto a polish rod: a lockable drive head shaft surrounding the polish rod; and a locking ram assembly for engaging a profile on the lockable drive head shaft; wherein the polish rod or rod clamp can be closed and locking ram assembly can be engaged in order to lock the polished rod in a safe manner.

Broadly stated, in some embodiments, a method of locking a polished rod or rod in a safe manner is provided, the method comprising providing a system as described herein; and locking the polished rod or rod.

Broadly stated, in some embodiments, a method of sealing a polished rod or rod in a safe manner comprising providing a system as described herein; and sealing the polished rod or rod.

Broadly stated, in some embodiments, a polish rod or rod safety clamp for clamping a seal onto a polish rod or rod is provided, as described and/or shown herein.

Broadly stated, in some embodiments, a lockable drive head shaft for surrounding a polish rod or rod is provided, as described and/or shown herein.

Broadly stated, in some embodiments, a locking ram assembly for engaging a lockable drive head shaft surrounding a polish rod or rod is provided, as described and/or shown herein.

Broadly stated, in some embodiments, a redundant seal system is provided, as described and/or shown herein.

Broadly stated, in some embodiments, a hydril is provided, as described and/or shown herein.

Broadly stated, in some embodiments, a removable ram assembly is provided, as described and/or shown herein.

In some embodiments, the polish rod or rod clamp can hold tri-directional loads, namely axial, rotational, and side forces, by holding a profile of the lockable drive head shaft. In some embodiments, when the polish rod or rod clamp is closed, the seal is engaged between the lockable drive head shaft, polish rod, and the polish rod or rod clamp locking a drive motor shaft profile on a drive head. In some embodiments, when the clamp is closed, a rotational lock profile will prevent the clamp from slipping and losing torque and will transmit the rotation directly from the lockable drive head shaft to the clamp and then to the polish rod or rod. In some embodiments, the system further comprises a centralizer on the polish rod at a lower end of the lockable drive head shaft. In some embodiments, the system further comprises a drive head shaft having a locking profile at the top of the drive motor shaft to hold a mating profile on the polish rod or rod clamp for tri-directional loads, namely axial, torque, and side loads. In some embodiments, the mating profile is configured to rotationally or hydraulically engage the lockable drive head shaft with the locking ram assembly. In some embodiments, the system further comprises a sealing surface on the lockable drive head shaft to receive a polish rod sealing device to engage the lockable drive head shaft with the polish rod and/or rod clamp tri-directional loads, namely axial, torque, and side loads. In some embodiments, the inner diameter of the lockable drive head shaft is enlarged to allow coil, rod and rotor service operation. In some embodiments, the system further comprises a secondary backup seal to seal the system against tubing pressure. In some embodiments, the lockable drive head shaft is configured to receive and mate with the locking ram assembly. In some embodiments, the locking ram assembly further comprises at least one locking shaft ram for engaging the lockable drive head shaft and preventing rotational movement of the lockable drive head shaft. In some embodiments, the seal is rubber, metal, or composite material. In some embodiments, the seal is replaceable.

DETAILED DESCRIPTION OF THE INVENTION

Figure 1:
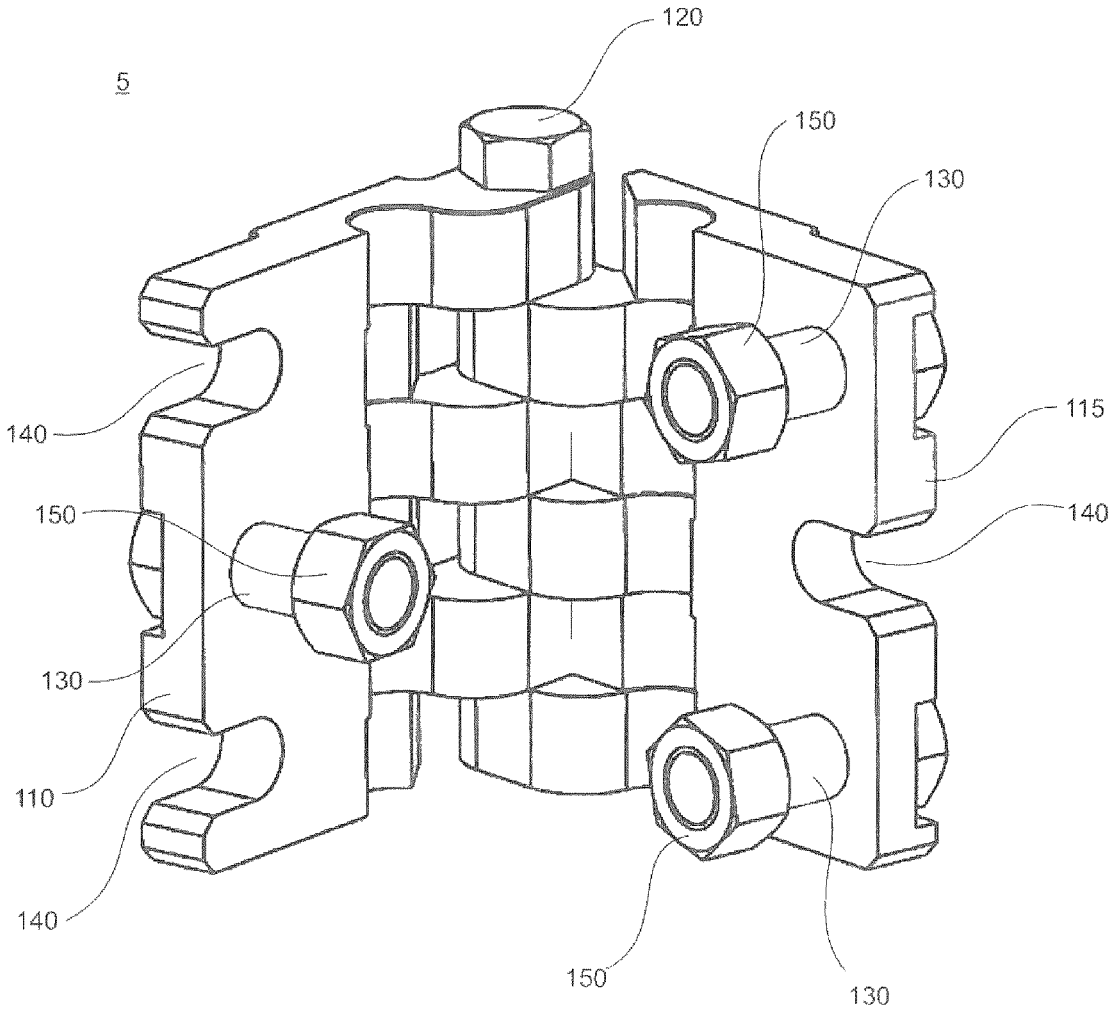
Fig. 1 Prior Art
FIG. 1 shows a conventional prior art rod clamp.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

The term "invention" and the like mean "the one or more inventions disclosed in this application", unless expressly specified otherwise.

The terms "an aspect", "an embodiment", "embodiment", "embodiments", "the embodiment", "the embodiments", "one or more embodiments", "some embodiments", "certain embodiments", "one embodiment", "another embodiment" and the like mean "one or more (but not all) embodiments of the disclosed invention(s)", unless expressly specified otherwise.

The term "variation" of an invention means an embodiment of the invention, unless expressly specified otherwise.

A reference to "another embodiment" or "another aspect" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise. The term "plurality" means "two or more", unless expressly specified otherwise. The term "herein" means "in the present application, including anything which may be incorporated by reference", unless expressly specified otherwise.

The term "e.g." and like terms mean "for example", and thus does not limit the term or phrase it explains.

The term "respective" and like terms mean "taken individually". Thus if two or more things have "respective" characteristics, then each such thing has its own characteristic, and these characteristics can be different from each other but need not be. For example, the phrase "each of two machines has a respective function" means that the first such machine has a function and the second such machine has a function as well. The function of the first machine may or may not be the same as the function of the second machine.

The term "rod" can refer to any appropriate rod, including a polish rod.

Where two or more terms or phrases are synonymous (e.g., because of an explicit statement that the terms or phrases are synonymous), instances of one such term/phrase does not mean instances of another such term/phrase must have a different meaning. For example, where a statement renders the meaning of "including" to be synonymous with "including but not limited to", the mere usage of the phrase "including but not limited to" does not mean that the term "including" means something other than "including but not limited to".

Neither the Title (set forth at the beginning of the first page of the present application) nor the Abstract (set forth at the end of the present application) is to be taken as limiting in any way the scope of the disclosed invention(s). An Abstract has been included in this application merely because an Abstract of not more than 150 words is required under 37 C.F.R. Section 1.72(b) or similar law in other jurisdictions. The title of the present application and headings of sections provided in the present application are for convenience only, and are not to be taken as limiting the disclosure in any way.

Numerous embodiments are described in the present application, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural and logical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

With reference to FIG. 1, a conventional prior art rod clamp 5 is shown. Existing clamps do not prevent a production rod from coming uphole due to uphole forces.

Figure 2:
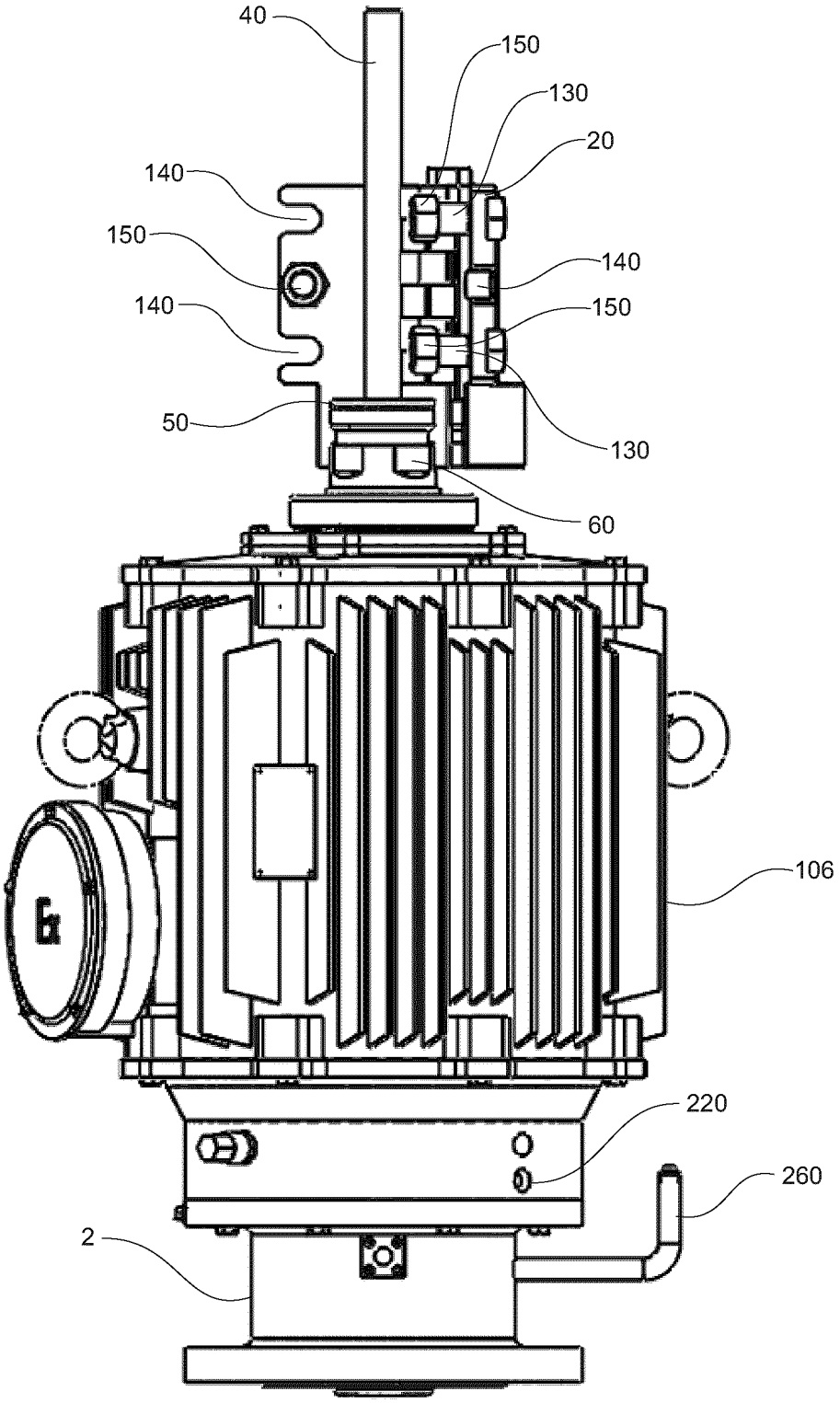
FIG. 2 shows a front elevation view of a well drive head with an embodiment of a sealing/locking rod clamp in an open (unlocked) position.
Figure 3:
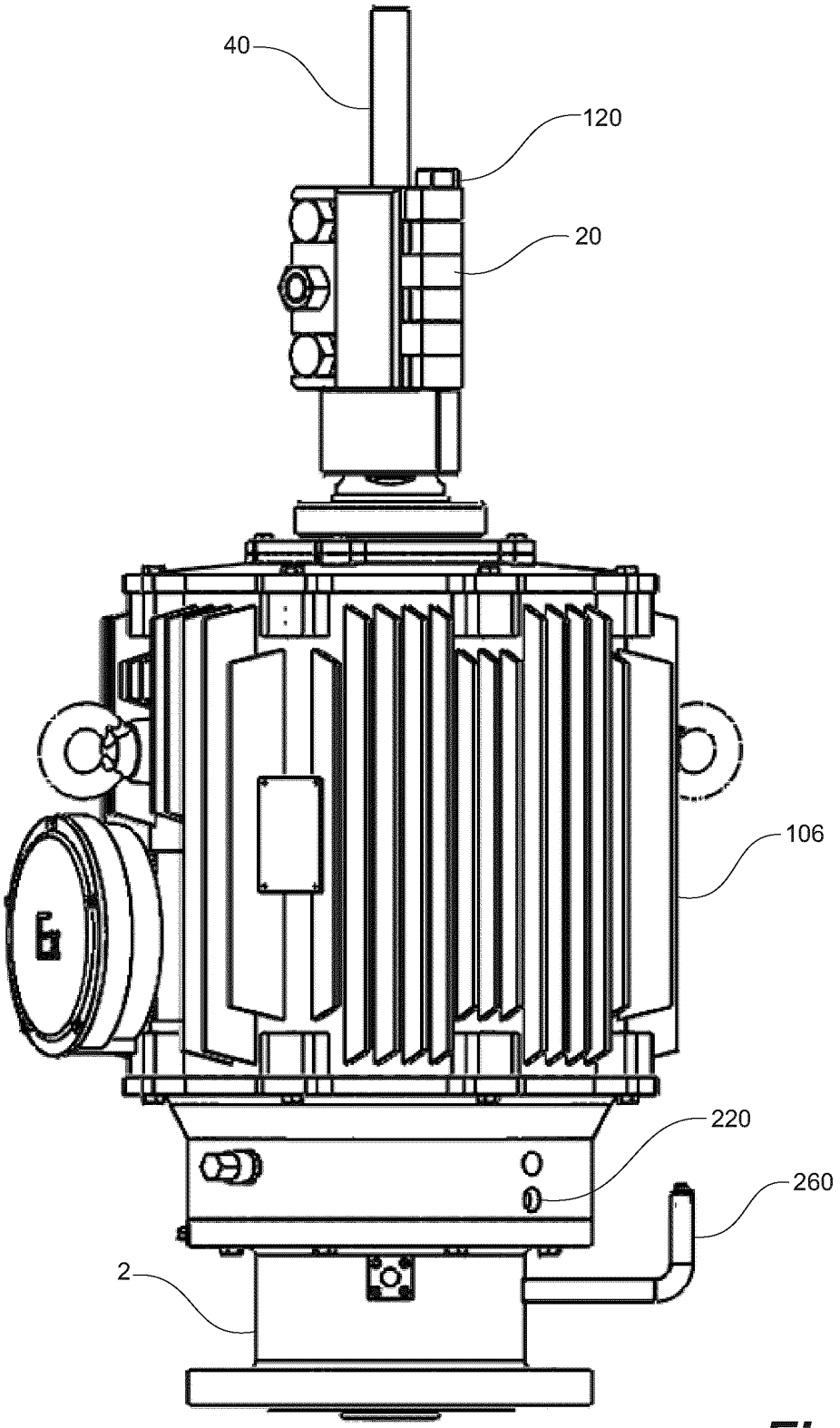
FIG. 3 shows a front elevation view of a well drive head with an embodiment of a sealing/locking rod clamp in a closed (locked) position.
Figure 4A:
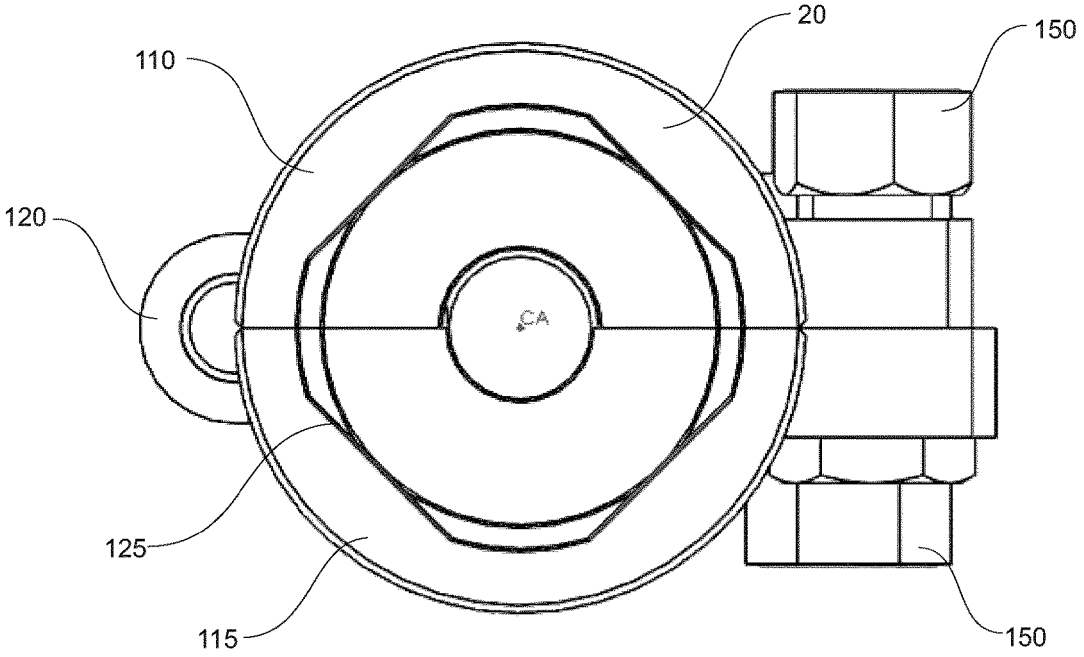
FIGS. 4A and 4B are bottom planar views of an embodiment of a sealing/locking rod clamp in closed (locked) and an open (unlocked) position, respectively.
Figure 4B:
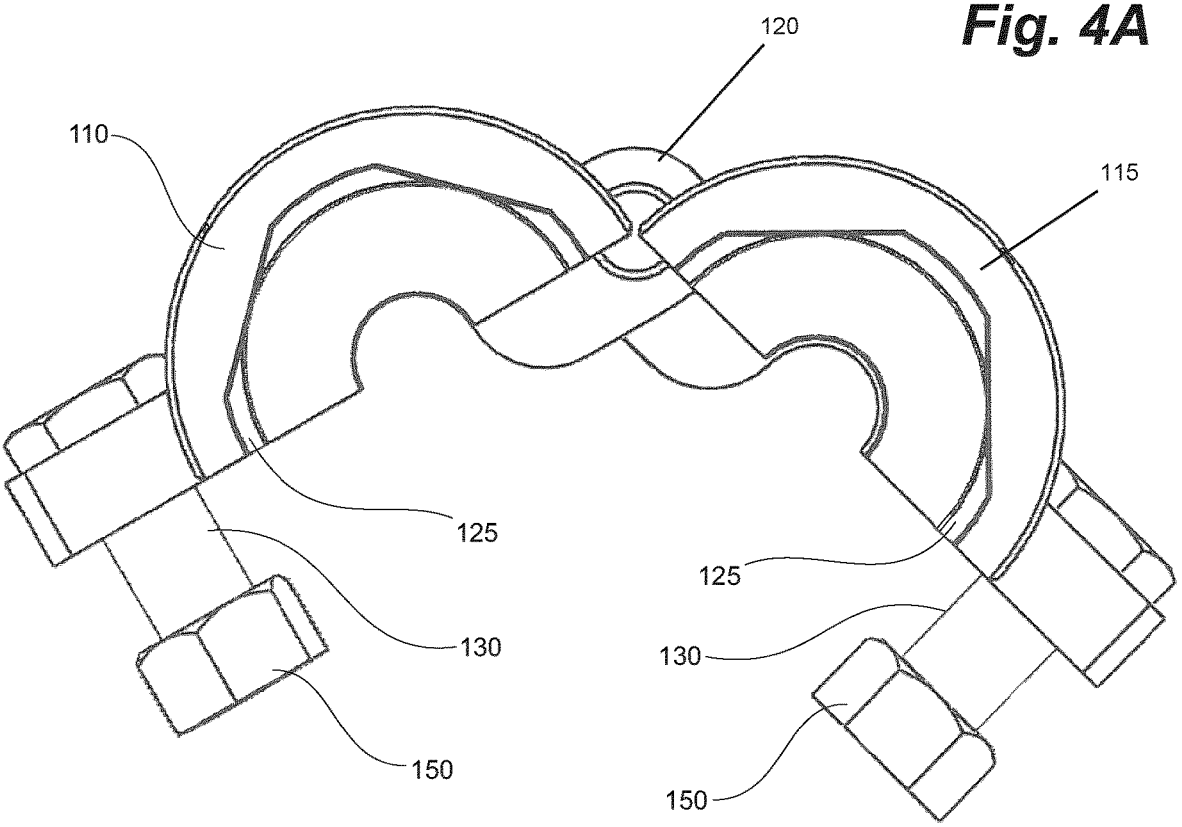
Figure 4C:
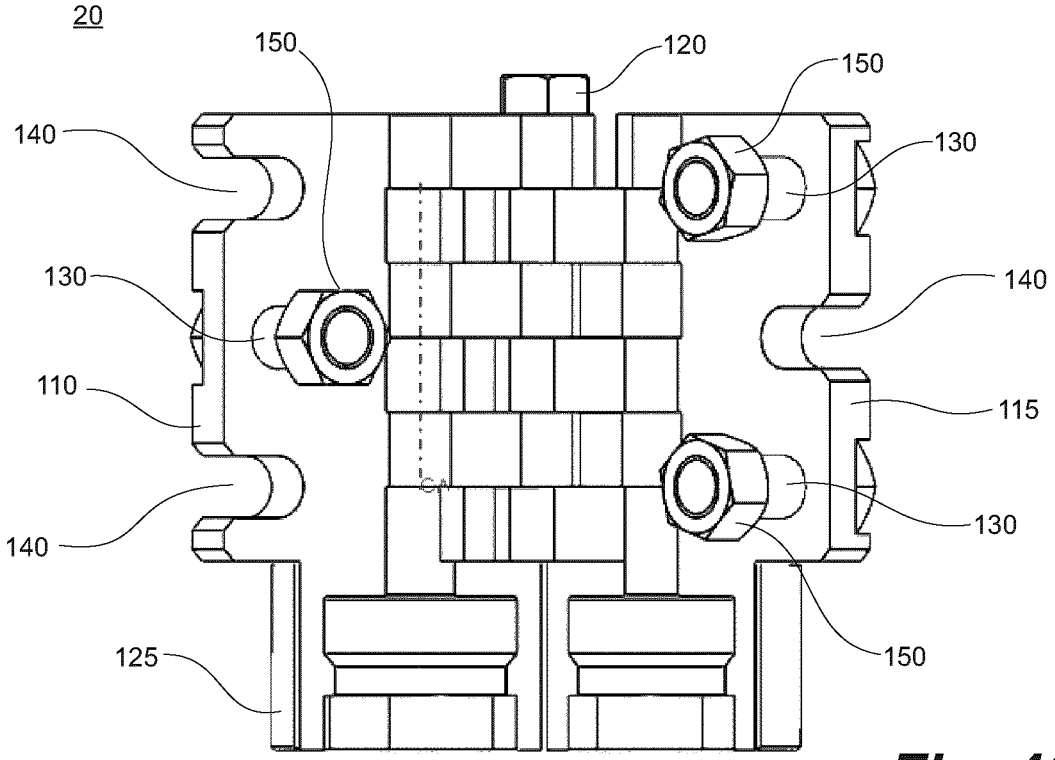
FIGS. 4C and 4D are front elevation views of an embodiment of a sealing/locking rod clamp in an open (unlocked) and closed (locked) position, respectively.
Figure 4D:
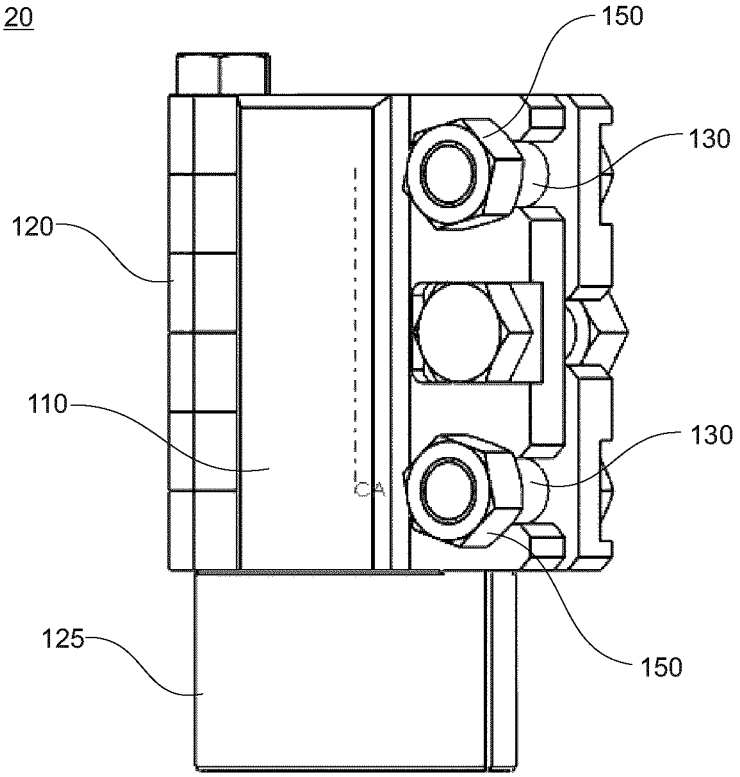

With reference to FIG. 2, there is shown an oil wellhead according to the present invention, in production mode. The well includes a well casing 2 extending from the surface of the ground down into the oil bearing strata. The casing maintains the well in an open condition and prevents caving and sloughing of material into the well. Tubing string can be situated within the casing 2. A variety of different types of production equipment may be positioned upon the wellhead above a rotating split tubing hanger, or surface tubing rotator and rod BOP, including well drive head 106. A pump rod or polish rod can extend from drive head 106 through tube string.

Locking/sealing safety clamp 20, as shown in FIGS. 2 to 6, can be configured to lock onto the drive head 106 motor with drive head locking shaft 30 and sealing at drive head locking shaft 30 to polish rod 40. This can reduce the cost and operation of the well by removing the need for a stuffing box above or below the drive head 106. Locking/sealing safety clamp 20 can hold polish rod 40 in tension (compression) and can prevent the pump rod from being forced out of hole while rotating. Locking/sealing safety clamp 20 can comprise clamp profile 125 which can lock onto a custom mating profile 60 at drive head locking shaft 30 and can seal device 50 seals drive head locking shaft 30 at polish rod 40 when clamp is closed. Seal device 50 can be easily replaced without pulling a stuffing box off or motor off the well head, thereby reducing the cost required on the replacement of a pressure sealing device on service.

Locking/sealing safety clamp 20 can include first portion 110 rotatable around second portion 115 at hinges 120 to surround polish rod 40. First and second portions 110, 115 can support locking members 130 sized to fit into recesses 140 in second portion and first portion 115, 110, respectively. Nuts 150 at the end of each locking member 130 can secure first portion 110 to second portion 115 around polish rod 40. Seal device 50 can be positioned proximate to the bottom of locking/sealing safety clamp 20 and can be made of rubber or metal to seal to polish rod 40. Locking/sealing safety clamp 20 can include a locking component including drive head locking shaft 30 mating profile 60 and clamp profile 125 which can lock first portion 110 to second portion 115 when holding polish rod 40. In some embodiments, locking/sealing safety clamp 20 can have a taper structure. A taper profile can aid in engaging the sealing and can hold the locking/sealing clamp 20 tight against the drive head locking shaft 30. The shape of locking/sealing safety clamp 20 can also provide torque transition to the polish rod 40.

Locking/sealing safety clamp 20 can hold bi-directional axial force by holding the polish rod 40 and the drive head locking shaft 30 profile 60. When locking/sealing safety clamp 20 is closed, seal device 50 is engaged between the drive head locking shaft 30, polish rod 40, and locking/sealing safety clamp 20 can be locked to drive head locking shaft 30 mating profile 60. When locking/sealing safety clamp 20 is closed, it also has a rotational lock profile 125 that can prevent locking/sealing safety clamp 20 from slipping and losing torque. Locking/sealing safety clamp 20 transmits the rotation directly from the drive head locking shaft 30 to the polish rod 40. A centralizer can be positioned on the polish rod 40 at the lower end of drive head locking shaft 30.

In some embodiments, the locking/sealing safety rod clamp system can comprise a hydril, valve, or cap to be used in addition to, or in place of locking/sealing safety clamp 20. When sealing/locking safety clamp 20 is removed from polish rod 40, in order to strip polish rod 40, but while wanting to retain pressure in the system, a hyrdril can be put in place. The hydril can have a tapered lower profile, such as clamp profile 125, for engaging seal device 50 at drive head locking shaft 30 and forming a seal, when hydril is put in place.

The method of using locking/sealing safety clamp 20 to hold bi-directional axial loads and sealing at the drive head locking shaft 30 can require changes to the existing drive head 106 to handle the loads. The changes to a drive motor would be to enlarge the inner diameter (ID) of drive head locking shaft 30 to two, or more, inches to allow for service operation without restrictions or removing the drive head 106. Due to locking/sealing safety clamp 20 now holding drive head locking shaft 30 at the top of drive head 106, upgrading the bearings to hold up-hole loads may be needed. The larger drive shaft outer diameter (OD) and ID requires larger bearings, so the load of the updated direct drive motor (PMM) or drive head would need to accommodate the torque and axial forces. Due to being a direct drive, the drive head locking shaft 30 will have to have rotating seal technology at the bottom end and to apply a drive shaft lock, such as described below. Due to the changes, using oil or grease can allow for extended run life and servicing the direct drive motor (PMM) would only need to change the oil or grease on location. All this can naturally improve the product performance to accommodate the locking/sealing safety clamp 20 improvements.

The drive head 106 can have a locking profile that will hold the mating profile on the locking/sealing safety rod clamp system on tri-directional load (namely, axial, torque, and side forces) and have a mating profile to engage drive head locking shaft 30. Locking/sealing safety clamp 20 can include seal device 50 configured to engage with drive head locking shaft 30. The inner diameter of drive locking shaft can be enlarged to allow coil, rod and rotor service operation. The lower end of locking/sealing safety clamp 20 can be sealed against tubing pressure.

Figure 5:
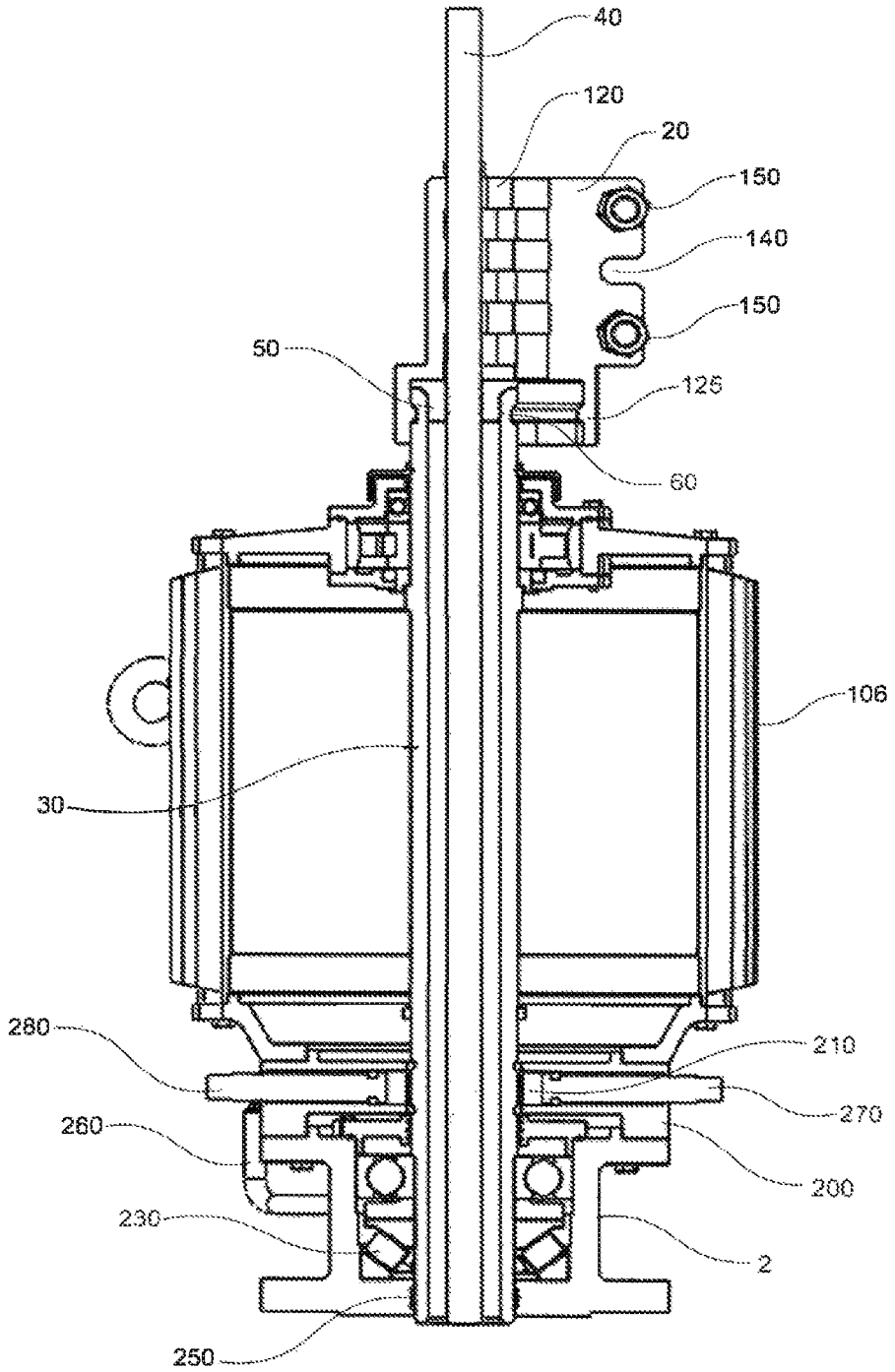
FIG. 5 shows a front elevation cross sectional view of a well drive head with an embodiment of a sealing/locking rod clamp, locking shaft, and locking ram assembly.
Figure 6:
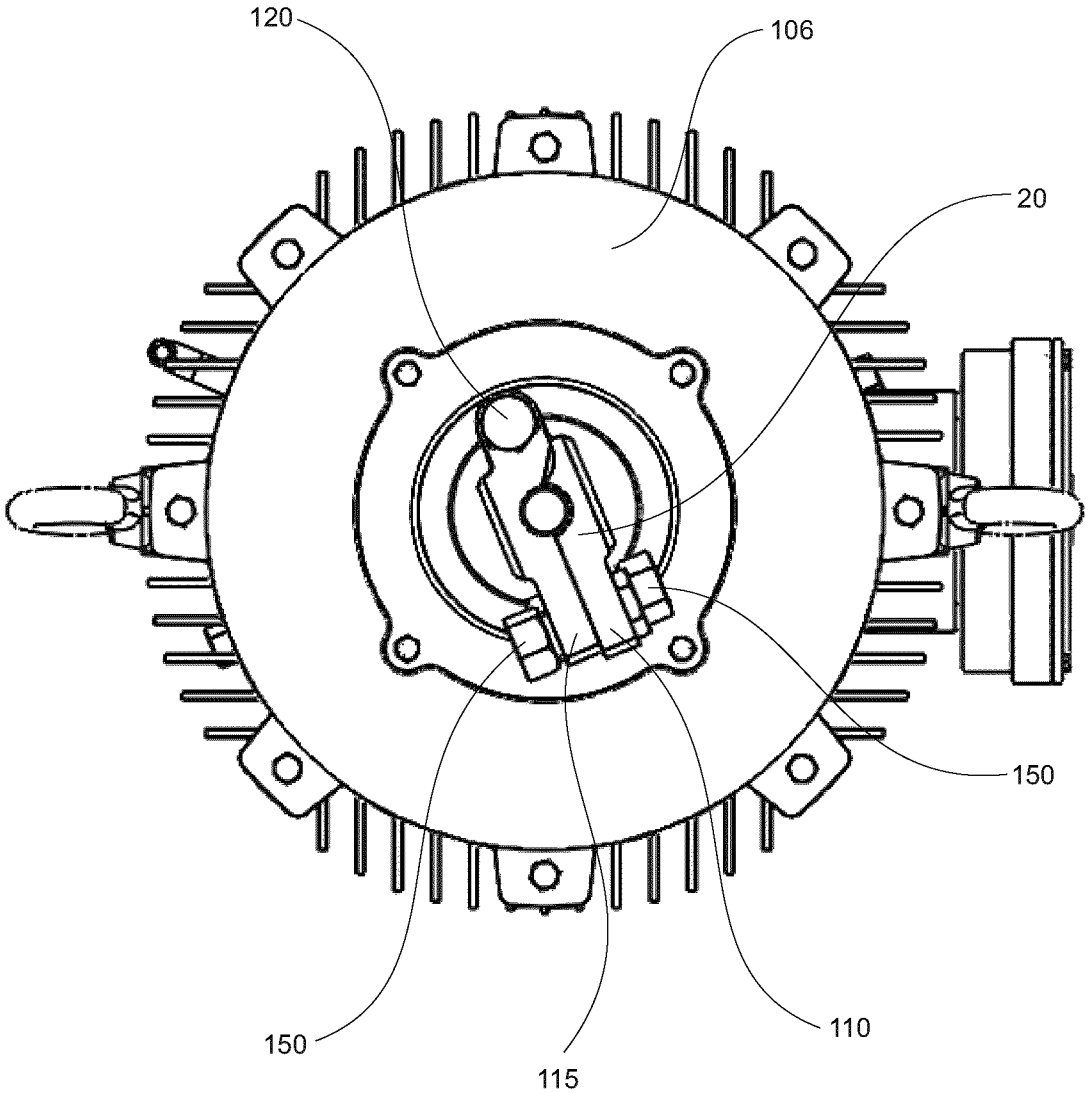
FIG. 6 is a top planar view of a well drive head with an embodiment of a sealing/locking rod clamp in a closed (locked) position.
Figure 7A:
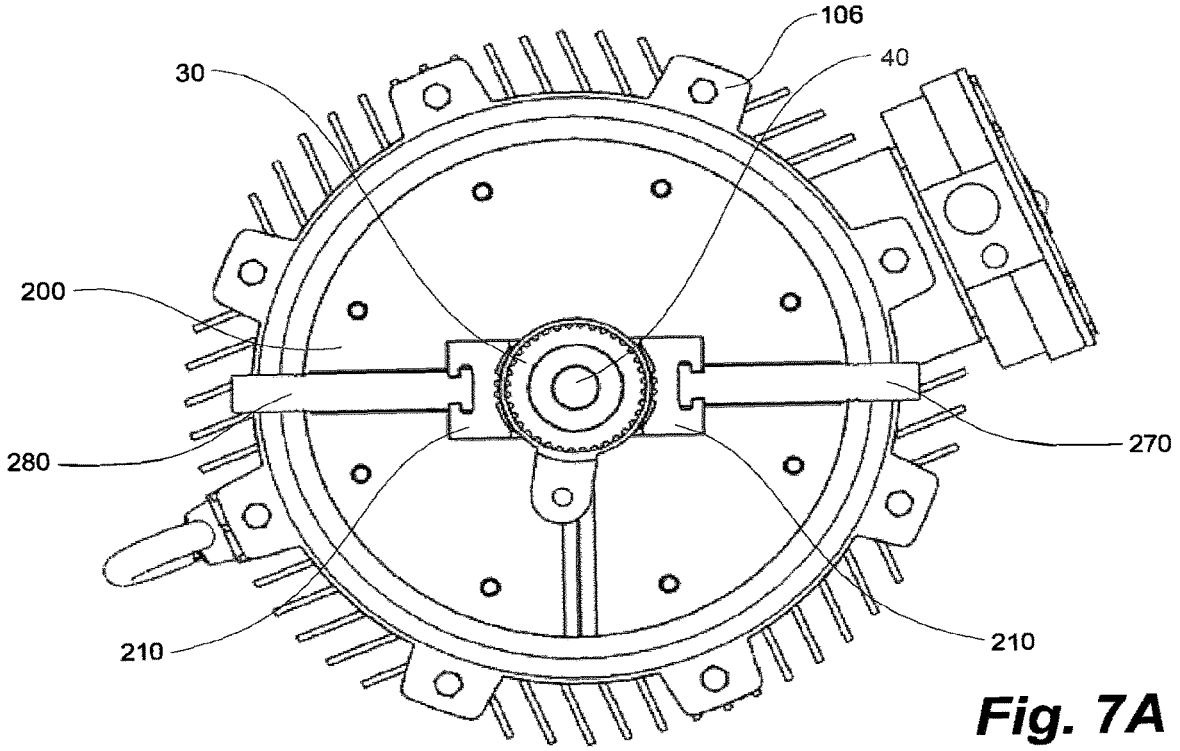
FIG. 7A is a cross-sectional top planar view of an embodiment of a direct drive shaft locking shaft and ram assembly.
Figure 7B:
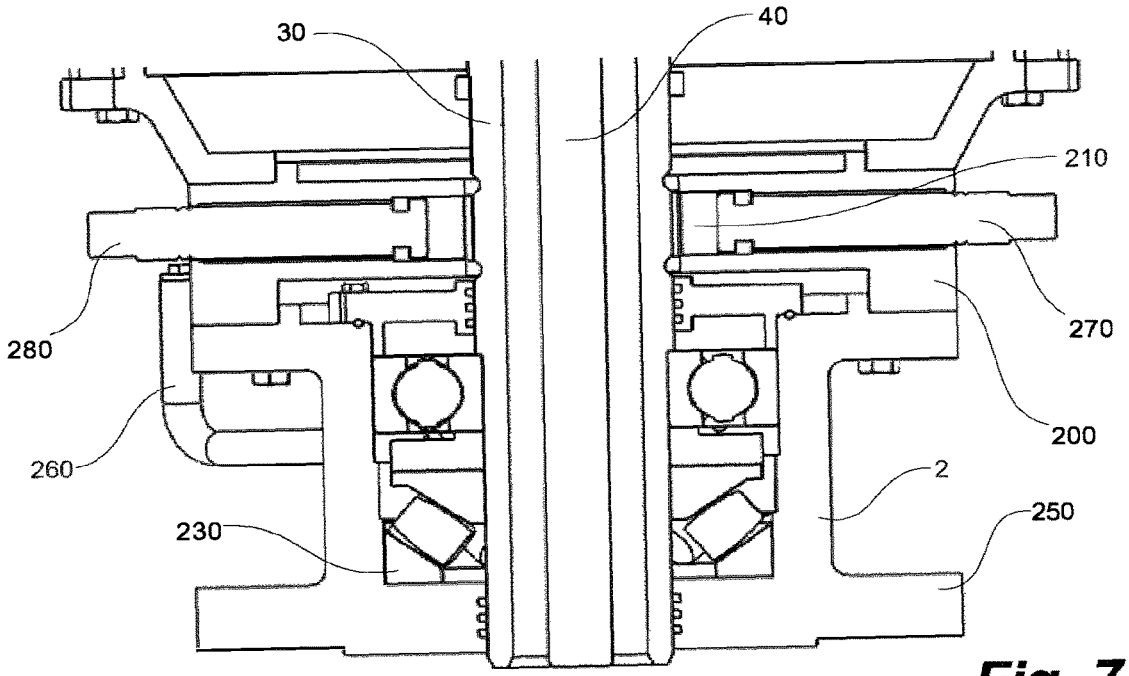
FIG. 7B is a side view thereof.

With locking/sealing safety clamp 20 already sealing and holding the axial load, it is only required to hold the drive head locking shaft 30 on the drive head 106. It is not necessary to hold polish rod 40 with a locking BOP for safety, as it is held with locking/sealing safety clamp 20. Therefore, as shown in FIGS. 5 to 7 locking/sealing safety clamp 20 may be operated alone or in conjunction with a locking drive shaft ram 200. Alternatively, locking drive shaft ram 200 may be used independently of locking/sealing safety clamp 20.

Locking drive shaft ram 200 can include locking rams 210 for contacting and holding drive head locking shaft 30 at drive head 106. Drive motor seal assembly 250 includes inlet 260 for oil or grease lubrication at the seal bearing rotating drive assembly on drive head 106. Lubrication bath viewing window 220 can allow a user to monitor lubrication status and/or leakage into a leakage indicator.

In some embodiments, drive motor seal assembly 250 can comprise a redundant seal system. Redundant seals can be used below and/or above bearing assembly 230. The primary seals will function as the system is pressurized and the redundant seals can operate in the event of a leak from the primary seal. Accordingly, the redundant seals will prevent leaks if the primary seals fail. In some embodiments a leak sensor can also be included. A leak sensor can indicate a failure of a primary seal, and the redundant seal can operate to prevent further leaking until the primary seal can be serviced.

Locking rams 210 can comprise aligned elongated member ram stems 270, 280 at opposite sides of ram 200, configured and/or shaped to be movable to hold drive head locking shaft 30, and be locked in position when there is no rotation. Locking rams 210 can be engaged when the drive head 106 is stopped. By equally rotating ram stems 270, 280 (for example, with a wrench, manually, or by hydraulics) until each engages the drive head locking shaft 30. Scribe marks on the ram stems 270, 280 can indicate the location of the locking rams 210 to the drive head locking shaft 30. The ram to shaft engagement can have hard surface to hard surface contact with a mating profile to prevent unnecessary rotation from drive head 106 that could spin the polish rod 40 and locking/sealing safety clamp 20. Such a configuration can allow for service work safety. The location and positioning of locking ram 210 in drive head 106 can hold the drive head locking shaft 30. In contrast, prior art devices and systems hold polish rod 40 with a locking BOP. The locking rams 210 can engage the drive head locking shaft 30 and prevent movement of the drive head 106 relative to locking/sealing safety clamp 20 with polish rod 40.

Figure 8A:
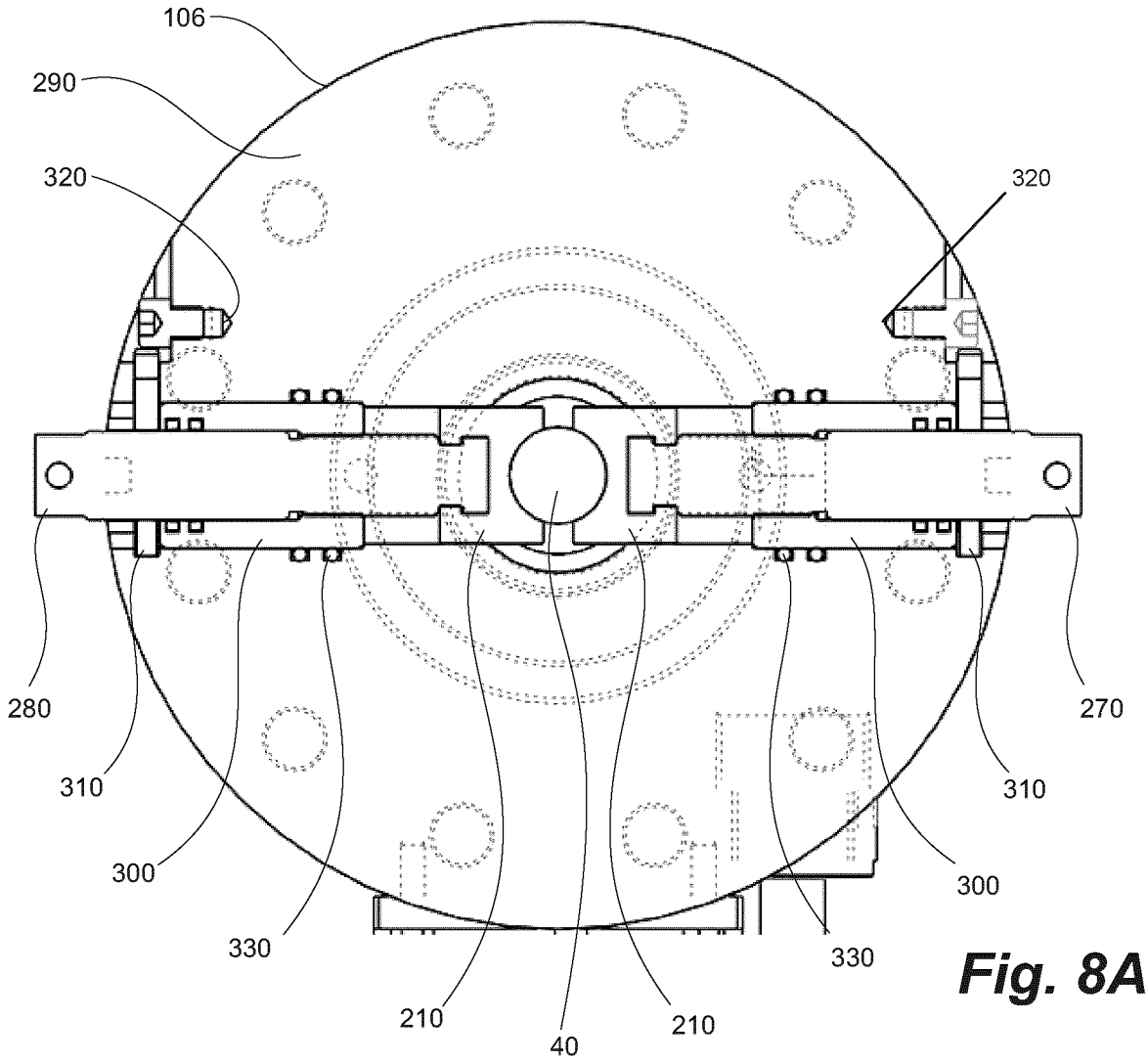
FIG. 8A is a top planar view of a threaded flange body, such as a well drive head, with an embodiment of a removable ram assembly.
Figure 8B:
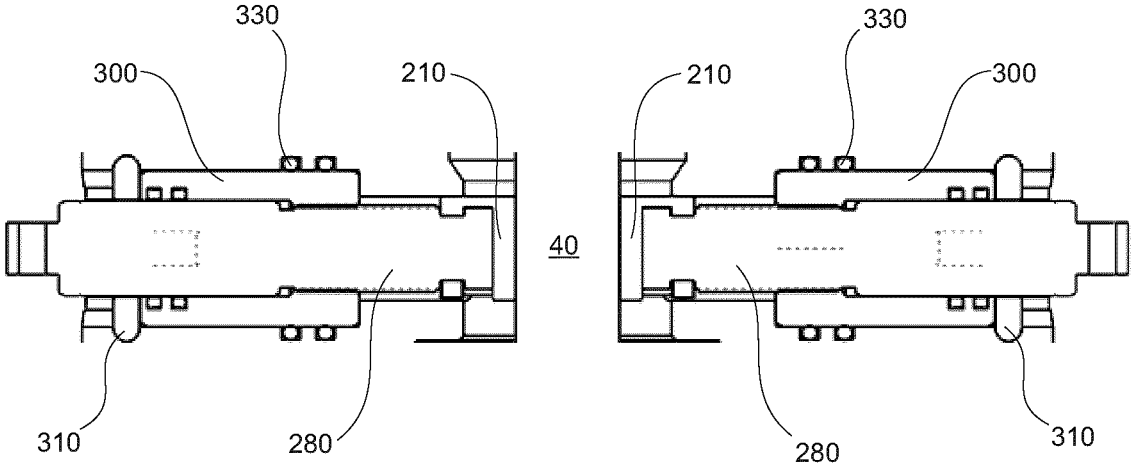
FIG. 8B is a cross-sectional side view thereof.
Figure 9:
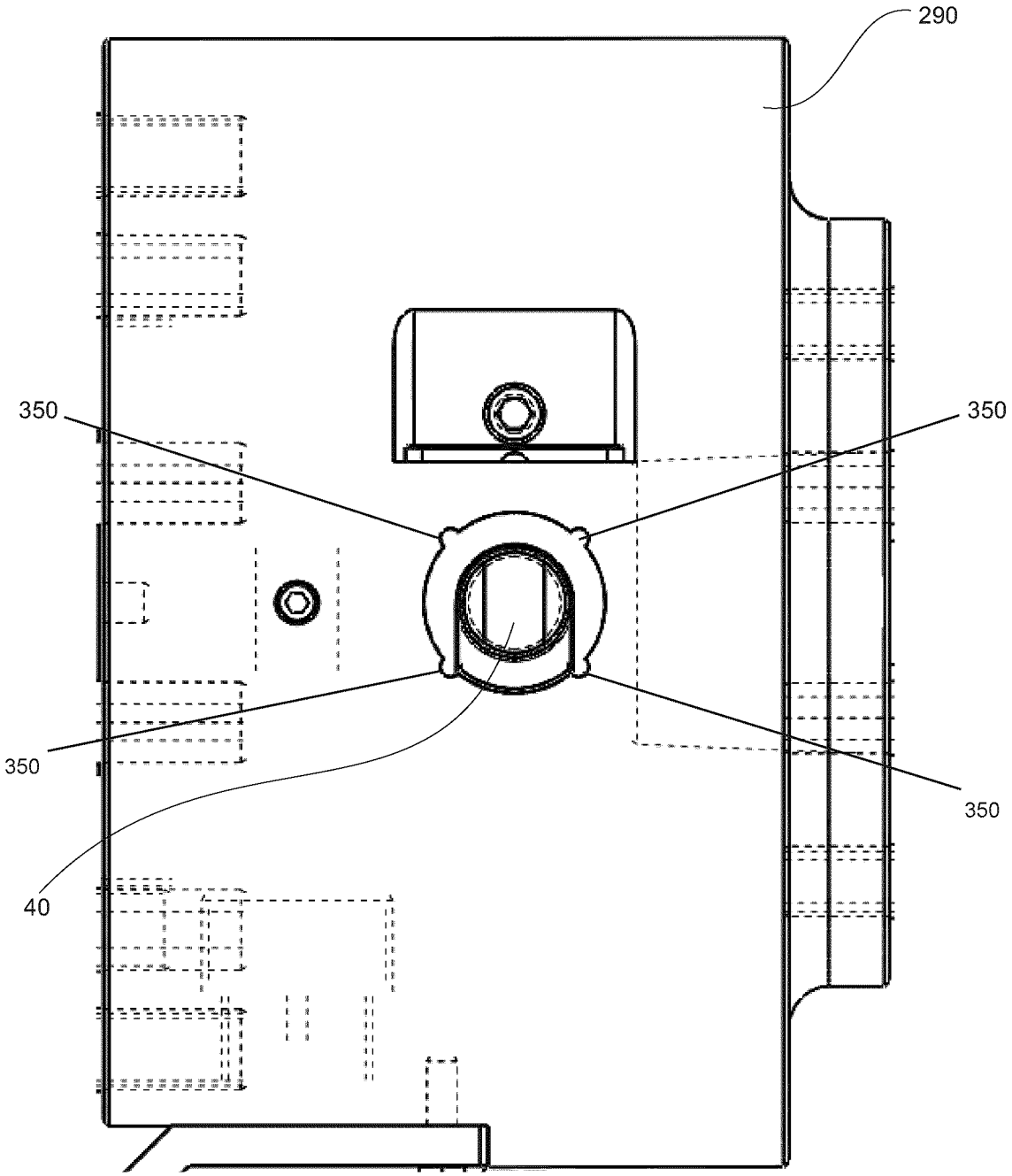
FIG. 9 is a side elevation view of a threaded flange body, such as a well drive head, with an embodiment of a removable ram assembly.

Referring to FIG. 8A and FIG. 8B, in some embodiments, the systems and methods described herein can use a removable ram assembly. Threaded shaft inserts 300 can be fit on main body 290 of drive head 106 in a manner to direct ram stems 270, 280 to releasably engage drive head locking shaft 30 or polish rod 40 with locking rams 210. Threaded shaft inserts 300 can be retained on main body 290 with retaining means such as threaded insert retainer 310 and retaining bolt 320. Seals 330 can be used to surround threaded shaft inserts 300 and create a seal between internal and external drive head 106 components. Seals 330 can be rubber or metal. Further, as depicted in FIG. 9, the removable ram assembly can be retained and/or covered, for example by a plate, and held with torque pins 350 to prevent unwanted rotational movement.

Removable threaded shaft inserts 300 can be used for many kinds of threaded applications where the threads can be damaged and an insert is replaceable on location instead with a thread on the part. This cuts the operational cost when a threaded main body is damaged and a service is required without pulling the assembly or shutting the operation to repair the damage. This insert 300 can slide onto the main body 290 and lock down with pins 350 and a retainer means 310. The removable ram assembly would be easily replaced if the thread is damaged on the removable threaded shaft insert 300 with a new insert. This can allow the main body to not be removed if the threads get damaged but shut down only for the service time. This assembly can work for any moving shafts that have threaded parts to move engaging parts.

Changes can be made to the present systems, methods and articles in light of the above description. In general, in the following claims, the terms used should not be construed to limit the invention to the specific embodiments disclosed in the specification and the claims, but should be construed to include all possible embodiments along with the full scope of equivalents to which such claims are entitled. Accordingly, the invention is not limited by the disclosure, but instead its scope is to be determined entirely by the following claims.

Further, in the methods taught herein, the various acts may be performed in a different order than that illustrated and described. Additionally, the methods can omit some acts, and/or employ additional acts.

I claim:

1. A clamp and locking ram system for a polish rod or a rod ("polish rod") rotated by a drive head, the drive head comprising a drive motor shaft profile, the system comprising:

a seal;

a clamp for clamping the seal onto the polish rod, wherein the clamp is configured to lock onto the polish rod;

a drive head locking shaft surrounding the polish rod;

a locking ram assembly for engaging a profile on the drive head locking shaft;

wherein the locking ram assembly is configured to lock the drive head locking shaft; and wherein when the clamp is closed, the seal is configured to be engaged between the drive head locking shaft and the polish rod, and the clamp is configured to lock with the drive motor shaft profile on the drive head.

2. The system of claim 1 wherein the clamp is configured to hold tri-directional loads, namely axial, rotational, and side loads, by holding the profile of the drive head locking shaft.

3. The system of claim 1, wherein when the clamp is closed, a rotational lock profile is configured to prevent the clamp from slipping and losing torque and is configured to transmit rotation directly from the drive head locking shaft to the clamp and to the polish rod.

4. The system of claim 1, further comprising a centralizer on the polish rod at a lower end of the drive head locking shaft.

5. The system of claim 1, further configured to lock onto the drive motor shaft profile and hold tri-directional loads, namely axial, torque, and side loads.

6. The system of claim 5, further configured to rotationally or hydraulically engage the drive head locking shaft with the locking ram assembly.

7. The system of claim 1, further comprising a sealing surface on the drive head locking shaft configured to receive a polish rod sealing device to engage the drive head locking shaft with the clamp tri-directional loads, namely axial, torque, and side loads.

8. The system of claim 1, wherein the inner diameter of the drive head locking shaft is configured to allow coil, rod and rotor service operation.

9. The system of claim 1, further comprising a secondary backup seal to seal the system against tubing pressure.

10. The system of claim 1, wherein the drive head locking shaft is configured to receive and mate with the locking ram assembly.

11. The system of claim 1, wherein the locking ram assembly further comprises at least one locking shaft ram for engaging the drive head locking shaft and preventing rotational movement of the drive head locking shaft.

12. The system of claim 1, wherein the seal is rubber, metal, or composite material.

13. The system of claim 1, wherein the seal is replaceable.

14. The system of claim 1 further comprising a hydril, wherein the system is disposed thereon.

15. The system of claim 1, wherein the ram assembly is removable.

16. A method of locking a polished rod or rod, comprising:

locking the polished rod or rod with the system of claim 1.

17. A method of sealing a polished rod or rod, comprising:

sealing the polished rod or rod with the system of claim 1.

* * * * *